US008347837B2

(12) United States Patent
Meintschel et al.

(10) Patent No.: US 8,347,837 B2
(45) **Date of Patent: *Jan. 8, 2013**

(54) INTERNAL COMBUSTION ENGINE VALVE DRIVE TRAIN SWITCHING ARRANGEMENT

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 461 days.

This patent is subject to a terminal disclaimer.

(21) Appl. No.: 12/658,584

(22) Filed: Feb. 8, 2010

(65) Prior Publication Data

US 2010/0199934 A1 Aug. 12, 2010

Related U.S. Application Data

(63) Continuation-in-part of application No. PCT/EP2008/006490, filed on Aug. 7, 2008.

(30) Foreign Application Priority Data

Aug. 10, 2007 (DE) ..... 10 2007 037 745

(51) Int. Cl.
*F01L 1/34* (2006.01)

(52) U.S. Cl. ..... 123/90.15; 123/90.16; 123/90.17

(58) Field of Classification Search ..... 123/90.15, 123/90.16, 90.17
See application file for complete search history.

(56) References Cited

U.S. PATENT DOCUMENTS

| | | | | |
|---|---|---|---|---|
| 2007/0034184 | A1 * | 2/2007 | Dengler | 123/90.17 |
| 2007/0204819 | A1 | 9/2007 | Elendt et al. | |

FOREIGN PATENT DOCUMENTS

| | | |
|---|---|---|
| CN | 100034 | 12/2011 |
| DE | 196 11 641 | 6/1997 |
| DE | 103 38 663 | 3/2005 |
| DE | 10 2004 022 833 | 12/2005 |
| DE | 10 2005 006 489 | 8/2006 |
| JP | 2005 0421717 | 2/2005 |
| JP | 2006 520869 | 9/2006 |
| JP | 2010-519380 | 6/2010 |
| JP | 2010 535965 | 11/2010 |
| JP | 2010 535966 | 11/2010 |
| WO | WO 2006/012959 | 2/2006 |

* cited by examiner

*Primary Examiner* — Zelalem Eshete
(74) *Attorney, Agent, or Firm* — Klaus J. Bach

(57) ABSTRACT

In an internal combustion engine valve drive train switching arrangement with a switching unit, the switching unit includes at least two control structure arranged at adjacent ends of at least two switching devices of the actuating units and an actuating unit cooperating with at least one control track formed by the switching devices of the actuating unit.

18 Claims, 18 Drawing Sheets

INTERNAL COMBUSTION ENGINE VALVE DRIVE TRAIN SWITCHING ARRANGEMENT

This is a Continuation-In-Part application of pending international patent application PCT/EP2008/006490 filed Aug. 7, 2008 and claiming the priority of German patent application 10 2007 037 745.4 filed Aug. 10, 2007.

BACKGROUND OF THE INVENTION

The invention relates to an internal combustion engine valve drive train switching arrangement for controlling the operation of valve actuators.

DE 10 2005 006 489 A1 discloses an internal combustion engine valve drive train switching device, wherein switching processes are coupled to each other so that they are performed simultaneously.

It is the object of the present invention to provide a valve drive train switching device in such a manner that installed size and weight costs are relatively low while a high operating safety is maintained.

SUMMARY OF THE INVENTION

In an internal combustion engine valve drive train switching arrangement with a switching unit, the switching unit includes at least two control means arranged at adjacent ends of at least two switching devices of the actuating units and an actuating unit cooperating with at least one control track formed by the switching devices of the actuating unit.

A "switching arrangement" is specifically meant to be a structure which is provided to control a switching process of at least one valve drive train. An "actuating unit" is meant to be a unit which carries out a process, especially a switching process, at least partially. A "control track" is meant to be at least one path or several guide paths including side walls, which are provided to guide a switching means during at least one switching process, and which extend individually or together over a defined angular area, extending over at least 10°, preferably over more than 80°, and especially preferred over more than 180° in the circumferential direction of a drive shaft or a component connected to the drive shaft, wherein the guide paths can be separated spatially from each other and this spatial separation can be cancelled by a switching process. A guide path means an elevation or a recess, which can have different extension forms which appear sensible to the expert, as especially an elongated extension form. A guide path can especially be a slot or a groove. A "slot" is meant to be a small recess. An "elevation" is meant to be an elevated area compared to the surrounding area and/or a bulge. A "switching process" comprises a relative movement and especially an axial relative movement between two components. A "switching unit" is a unit, which is provided to effect a switching process, especially also in a cooperation with at least one switching means or another unit. A "switching means" is especially meant to be a means, which is provided to effect a switching process, especially also in cooperation with at least one other switching means or another unit. A simple construction of the switching unit can be achieved with the arrangement of the invention.

In a preferred embodiment of the invention the actuating unit has at least two control means, which are positioned on ends facing each other of at least two switching units of the actuating unit. The extension of the individual control means can thereby be reduced. A "control means" is a means for controlling a process, especially for controlling a switching process. The switching units can especially be associated with different valves, which may be associated with different cylinders. The switching units however can also be associated with only one valve for a particularly flexible switching.

The control track is preferably formed by the control means. A switching device for switching processes between the switching units and the switching means can thereby be realized in a simple manner.

The control unit is preferably formed in such a manner that the switching units can be actuated by a switching means of the actuating unit in a defined switching sequence. The control tracks can thereby be used in a continuous operation. A "defined switching sequence" comprises switching processes taking place according to a predetermined order, which are at least partially chronologically offset and/or separate switching processes, which are also suitable for a continuous operation with at least two defined switching sequences.

It is further suggested that the actuating unit has at least one switching means, which is provided to effect a switching of a valve drive train by interaction with the control track. A reliable change of valve lift curves can be achieved hereby.

The actuating unit preferably has at least one switching means, and at least one of the switching units has at least one control means, wherein the control means and the switching means are provided to change at least one function of the switching unit and/or of the switching means due to an interaction amongst each other. A compact switching design can be achieved hereby. A "function" is a mode of operation and especially a mode of operation during an interaction with another design unit, which can for example be the switching means or the switching unit.

In this connection, an advantage can be achieved if the function involves a insertion of the switching means into the switching unit and/or a removal of the switching means from the switching unit and/or an actuation of the switching unit by the switching means and/or the change-over of the switching means from one switching unit to another switching unit and/or a resting of the movement of a switching unit. An effective mechanical switching device can be realized thereby. An insertion of the switching means into the switching unit means a movement of the switching means formed as a projection or a pin into a groove or a slot of a switching unit. A "removal" of the switching means from the switching unit means the removal of the switching means formed as a projection or a pin by retraction from the groove or the slot of the switching unit. A "resting" of the movement of a switching unit is further meant to refer to a resting position of the switching unit relative to the switching means after a movement of the switching unit relative to the switching means.

The actuating unit preferably comprises at least one switching means, which is provided to act upon the control track in at least one radial direction. A constructively simple interaction between the switching means and the control track can be achieved thereby. A "radial direction" is especially meant to be a radial direction in relation to a drive shaft. An "acting upon" the control track by the switching means is especially meant to mean that the switching means is provided to impinge on, and/or act, with a force on a guide path of a control track during a movement in a guide path of a control track.

The actuating unit can comprise an electronic evaluation unit and be provided to carry out a first switching process based on at least one signal and thereafter a second switching process in dependence on an electronic evaluation. The actuating unit is especially advantageously provided to carry out a first switching process based on at least one signal and thereafter a second switching process independently of an electronic evaluation. "Provided" is meant to be specially equipped and/or designed. A "signal" is thereby especially meant to be a triggering process and/or a sign, as for example a current pulse with a defined meaning and/or an acting upon and/or positioning of a mechanical component in a switching position and/or mechanical interaction initiated from the outside. A "triggering process" is especially meant to be a mechanical, electrical, quantum-mechanical, and/or electromechanical process, which can especially lead to a certain positioning of a switching means. An "actuating unit" in this connection is meant to be a unit which carries out at least one process once based on a signal and which can especially be formed of mechanical, quantum mechanical, electrical and/or electromechanical components, and especially also electronic components, if these do not influence the process at least in an inessential manner and especially preferred do not influence the process. A switching process taking place "after" another switching process is meant to be that the switching processes take place in at least a chronological offset manner and/or especially preferred in a chronologically overlap-free manner. An electronic "evaluation" is meant to be an electronic arrangement and/or assessing of a state and/or of a signal and/or of a process. An actuation "independent" of an electronic evaluation is especially meant to be an automated actuating in a mechanical, quantum-mechanical, electrical and/or electromechanical manner. A compact and reliably functioning assembly can be achieved according to the invention in a constructively simple manner.

The actuating unit is formed at least partially as a mechanical unit in a preferred embodiment of the invention. Construction costs can be saved hereby.

It is additionally suggested that the actuating unit is formed at least partially as a transmission. A simple construction of the actuating unit can be achieved thereby. The transmission can especially be formed as a cam transmission. Other transmissions which appear to be sensible to the expert are furthermore also conceivable, as for example gear transmissions, lever transmissions, hydraulic transmissions etc.

The actuating unit is advantageously provided to effect a switching of a valve drive train and/or a change of at least one valve lift curve and/or a switch-off of at least one valve and/or at least a change of operating modes of an internal combustion engine. A simple and efficient operation of the valves of a valve drive train can be achieved hereby. A "valve drive train" is especially meant to be a constructional unit which is provided to permit a gas change at least partially in internal combustion engines, which are based on a piston machine. A "switching" of a valve drive train is especially meant to be a change process for changing at least one property and/or at least one function of the valve drive train and/or the change between different operating modes. A "valve lift curve" is meant to be the graph of the function which is obtained when the valve lift relative to the cylinder with which the valve is associated is measured, is plotted over the rotary angle of the drive shaft associated with the valve drive train in a Cartesian coordinate system. "Different operating modes" is especially meant to be the actuation of valves with different control times and/or valve lift curves. A "change of the operating modes" is especially meant to be the operation of the internal combustion engine with full load, with partial load, in the self-ignition operation, with cylinder switch-off, with early or late inlet closure or further operating modes which appear sensible to the expert.

The actuating unit comprises at least one switching means in an advantageous arrangement of the invention, and the actuating unit is provided to actuate the switching units independently of each other at least in dependence on the positions of the switching units relative to the switching means in at least one operating mode. The number of the required switching means can be reduced thereby. The actuating unit "actuating" a switching unit is especially meant to be a cooperation and/or interaction of the actuating unit or parts of the actuating unit with the switching unit, which can effect a switching process. The actuating unit actuating the switching units "independently from each other" is especially meant to be that an actuation of a switching unit by the actuating unit does not influence an actuation of another switching unit by the actuating unit. An "operating mode" is especially meant to be the type of an operation.

In a preferred arrangement of the invention, the actuating unit has at least one switching means, which is provided to actuate the at least two switching units at least partially in a chronological offset manner in at least one operating mode. The number of the required switching means can be reduced hereby.

It is additionally suggested that the actuating unit has at least one switching means, which is provided to actuate at least one of the switching units in dependence on at least one position change of at least one of the switching units relative to the switching means. The number of the required switching units and the number of the required switching means can be reduced hereby.

It is further suggested that the actuating unit has switching means for operation in at least two different switching directions. A switching process can thereby be designed in a manner which saves components. A "switching direction" is especially meant to be a direction, in which a component is moved relative to the switching means with a switching process effected at least partially by the switching means, especially in a translational manner. Superposed movements, such as translational and rotating movements are also conceivable in principle.

The switching units are advantageously at least partially decoupled in their movement and correspond to at least one switching means of the actuating unit. The switching units can thereby be moved in different directions relative to the switching means. A switching unit can especially rest relative to the switching means, while another switching unit moves relative to the switching means. A switching unit "corresponding" to a switching means is especially meant to be a switching unit, which is formed in such a manner that it enables a switching process in cooperation with the switching means. At least partially "decoupled" switching units in their movement are especially meant to be switching units for which at least one movement of a switching unit relative to the other switching unit runs independently therefrom in at least one operating mode.

It is suggested further that the actuating unit is provided to actuate at least two switching units simultaneously in at least one operating mode. Hereby, it can be achieved in a constructively simple manner that a switching means of two switching units can actuate two switching units at least in a partially decoupled manner.

It is additionally suggested that the actuating unit has a camshaft, at least in large part, the switching units through which valve lift curves of valves associated with the camshaft can be changed, and at least one switching means, which is provided to actuate the switching units. A coherent switching can be achieved hereby and a faulty switching of individual cams can thereby be prevented. A "large part" is especially meant to be at least 50 percent, especially at least seventy percent, and especially advantageously at least ninety percent of the total number. A valve shall especially be "associated" with a camshaft, when the valve is opened and/or closed directly or indirectly by means of the camshaft.

The actuating unit preferably comprises a switching means, which is formed as a switching pin. A cost-effective arrangement of the switching means is thereby possible.

The actuating unit has advantageously at least one switching means, which is provided to effect an axial displacement of the switching unit relative to the switching means by an interaction with at least one switching unit, and thereby effect a switching of at least one valve drive train. The valve drive train can hereby be switched in a constructively simple manner. An "axial" displacement of the switching unit is especially meant to be a displacement of the switching unit in a main extension direction of a drive shaft, which can be a camshaft.

It is further suggested that at least one switching unit is formed as an axially displaceable part of a camshaft with cams with at least partially different contours. In this manner, the switching unit can directly carry out a switching process at a cam. A "cam" is especially meant to be a cam-like projection on a shaft rotating in an operating mode, which can be formed as a camshaft. An "at least partially differently formed contour" is especially meant to be a different extension of the projections of different cams and/or of a cam.

The invention will become more readily apparent from the following description of a particular embodiment thereof on the basis of the accompanying drawings.

BRIEF DESCRIPTION OF THE DRAWINGS

It is shown in.

DETAILED DESCRIPTION OF EMBODIMENTS OF THE INVENTION

Figure 1:
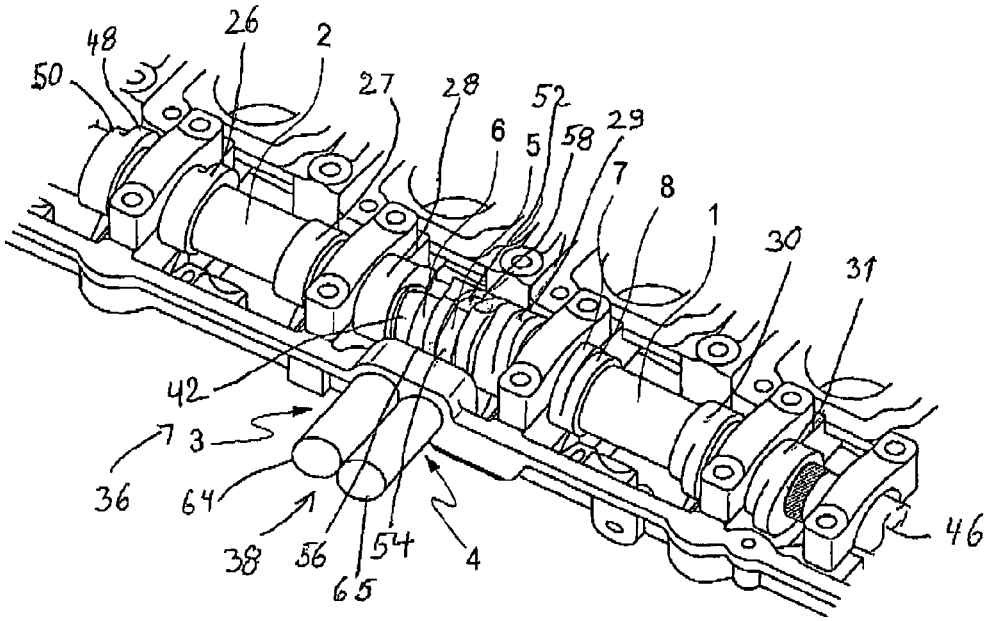
FIG. 1 parts of an internal combustion engine valve drive train switching arrangement with a switching unit, FIG. 2 a development of a control track, FIG. 3 a top view of developments of two control tracks, FIGS. 4*a* and 4*b* an intermediate state during a first step of a switching process to the right, FIGS. 5*a* and 5*b* an intermediate state during a second step of a switching process to the right, FIGS. 6*a* and 6*b* an intermediate state during a third step of a switching process to the right, FIGS. 7*a* and 7*b* an intermediate state during a fourth step of a switching process to the right, FIGS. 8*a* and 8*b* an intermediate state during a fifth step of a switching process to the right, FIGS. 9*a* and 9*b* an intermediate state during a sixth step of a switching process to the right, FIGS. 10*a* and 10*b* an intermediate state during a seventh step of a switching process to the right, FIGS. 11*a* and 11*b* an intermediate state during an eighth step of a switching process to the right, FIGS. 12*a* and 12*b* an intermediate state during a first step of a switching process to the left, FIGS. 13*a* and 13*b* an intermediate state during a second step of a switching process to the left, FIGS. 14*a* and 14*b* an intermediate state during a third step of a switching process to the left, FIGS. 15*a* and 15*b* an intermediate state during a fourth step of a switching process to the left, FIGS. 16*a* and 16*b* an intermediate state during a fifth step of a switching process to the left, FIGS. 17*a* and 17*b* an intermediate state during a sixth step of a switching process to the left, FIGS. 18*a* and 18*b* an intermediate state during a seventh step of a switching process to the left, FIGS. 19*a* and 19*b* an intermediate state during an eighth step of a switching process to the left.

FIG. 1 shows an internal combustion engine valve drive train switching device with a switching unit 36, which has two actuators 64, 65, a camshaft 46 and an actuating unit 38, which is provided to perform a first switching process based on a signal, and then a second switching process independently of an electronic evaluation. The actuating unit 38 has only mechanical components and is thus formed as a mechanical unit. The actuating unit 38 further comprises two switching means or pins 3, 4 respectively formed by a switching pins 3, 4, which can be actuated by the actuators 64, 65 that is moved into, or out of, the actuators 64, 65. The actuating unit 38 additionally comprises switching units 1, 2, which are axially movably disposed on the camshaft 46. The switching units 1, 2 have a common main extension direction, which coincides with a main extension direction of the camshaft 46. The switching pins 3, 4 also have a common main extension direction, which extends radially to the camshaft 46 and to the switching units 1, 2.

The switching means 3, 4 are respectively provided to actuate the two switching units 1,2. During movement of a switching means 3, 4, which takes place In its main extension direction towards the switching units 1, 2, the switching means is biased onto a switching unit 1, 2, and then an interaction between the switching means 3, 4 and the switching units 1, 2 occurs, which is described by means of FIGS. 4*a* to 19*b*, and due to which an axial displacement of the switching units 1, 2 relative to the switching means 3, 4 along the main extension direction of the switching units 1, 2 takes place. An axial displacement of cams 7, 8, 48, 50, 26, 27, 28, 29, 30, 31 belonging to the switching units 1, 2 takes place with the axial displacement of the switching units 1, 2. The cams 7, 8 and 48, 50 have a different contour in that the maximum radial extension of the cams 8, 50 is different to the maximum radial extension of the cams 48, 7. As the camshaft 46 only comprises the cams 7, 8, 48, 50, 26, 27, 28, 29, 30, 31, both switching means 3, 4 can respectively actuate the switching units 1, 2, by which valve lift curves of valves which are associated with the camshaft 46, can be changed.

The switching unit 1 has a control means 52, which is formed by sections 9, 11, 13, 16, 18 (see FIG. 3), which are four grooves. The switching unit 2 further has a control means 54, which is formed by sections 10, 12, 14, 15, 17 (see FIG. 3), which are four grooves. The control means 52, 54 are positioned in end regions or on ends 56, 58 of the switching units 1, 2, which face each other in the main extension direction of the camshaft 46 and are directly adjacent to each other. The control means 52, 54 form two control tracks 5, 6, which are arranged behind each other in the main extension direction of the camshaft 46. The control tracks 5, 6 are thus respectively formed by the two switching units 1, 2.

The switching means 3, 4 are arranged in such a manner that they can act upon the control tracks 5, 6 in the radial direction during a switching process. The switching means 3, 4 are arranged successively along the main extension direction of the camshaft 46 in the same sequence as the control tracks 6, 5. The switching means 3 can act upon the control track 6, and the switching means 4 can act upon the control track 5.

Figure 2:
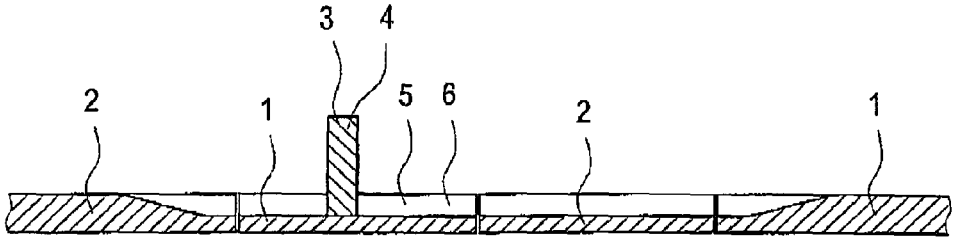

FIG. 2 shows a development of one of the control tracks 5 or 6, which extends over more than one camshaft rotation, namely over about 540°. Other angular regions which appear to be sensible to the expert are also conceivable.

According to the invention, each of the control tracks 5, 6 permits a change of the switching means 3, 4 during a switching process from one switching unit 2 to another switching unit 1 and back.

Figure 3:
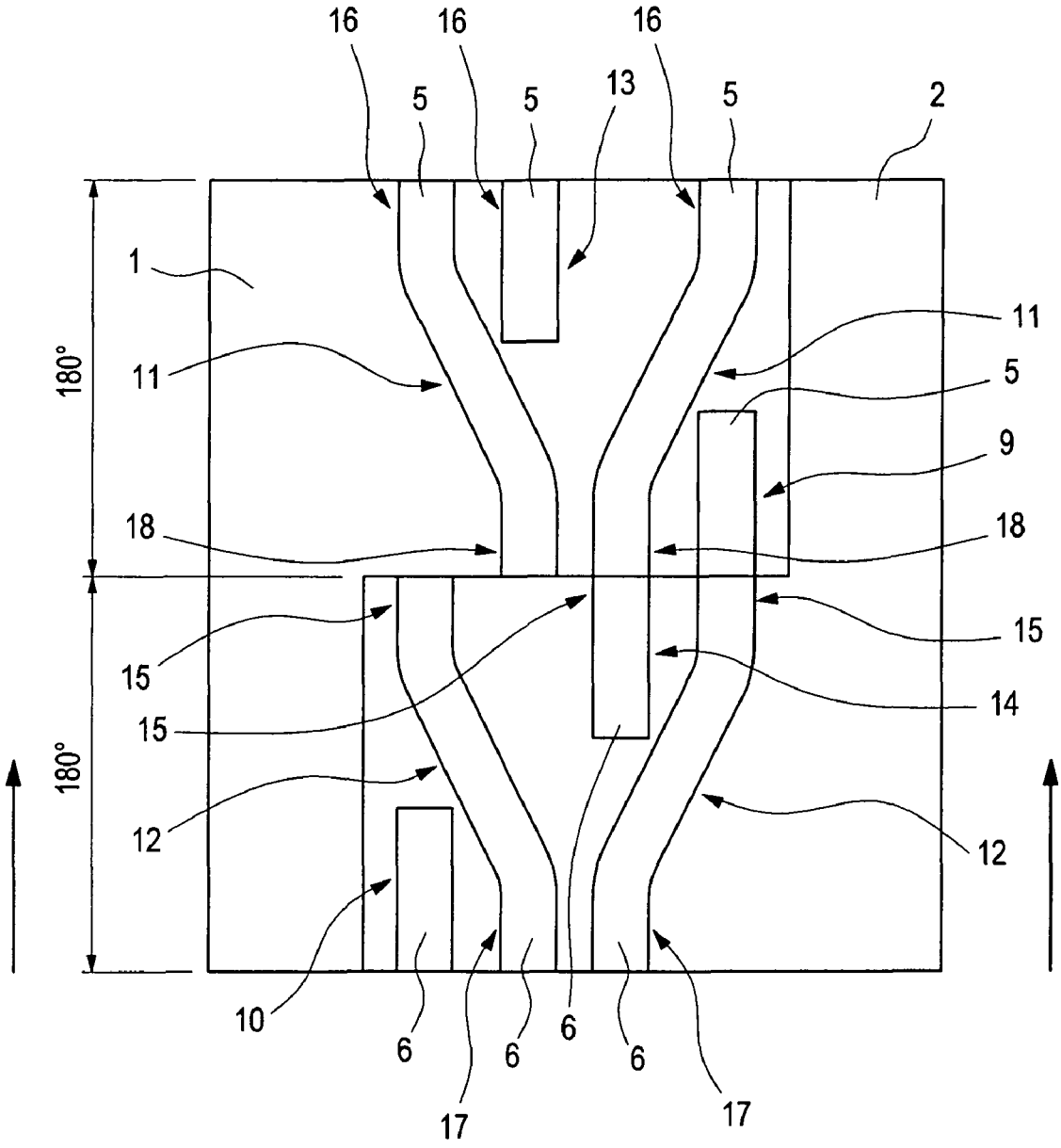
Figure 4B:
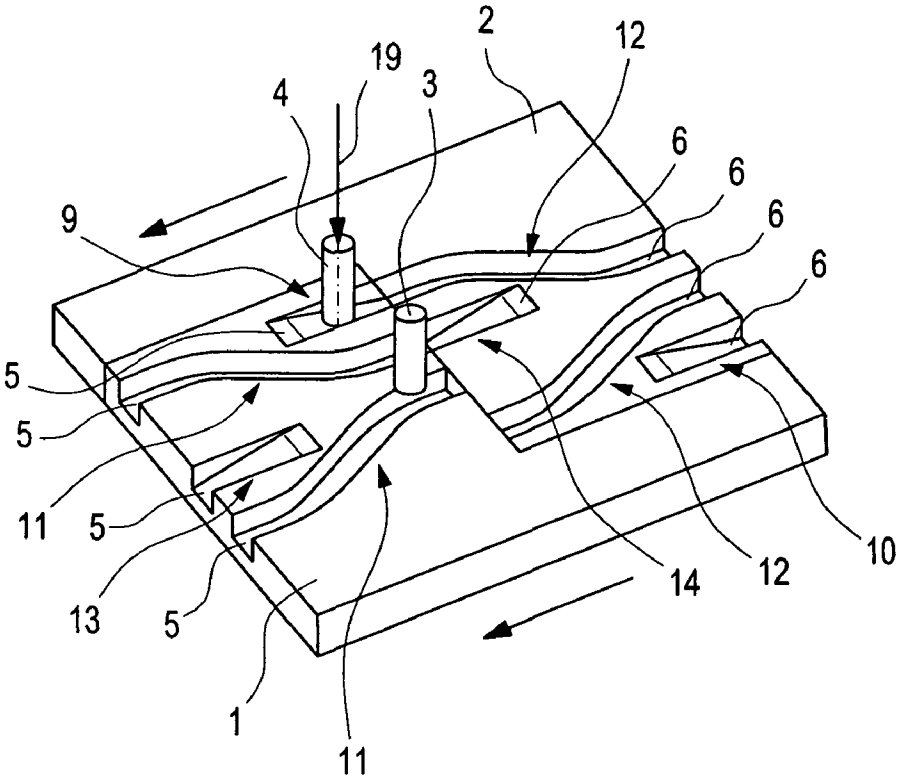
Figure 4A:
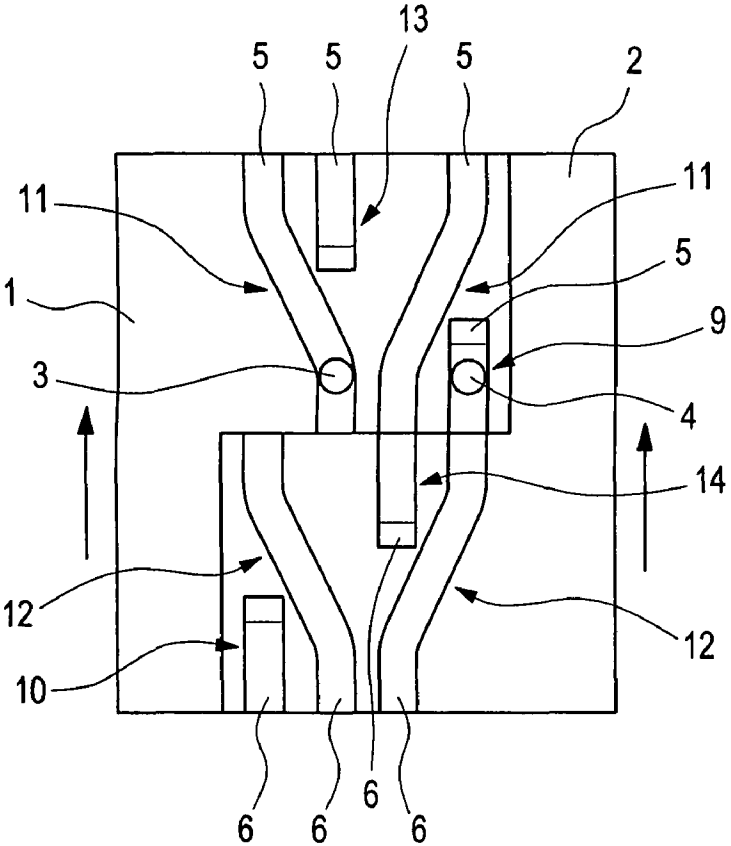
Figure 5B:
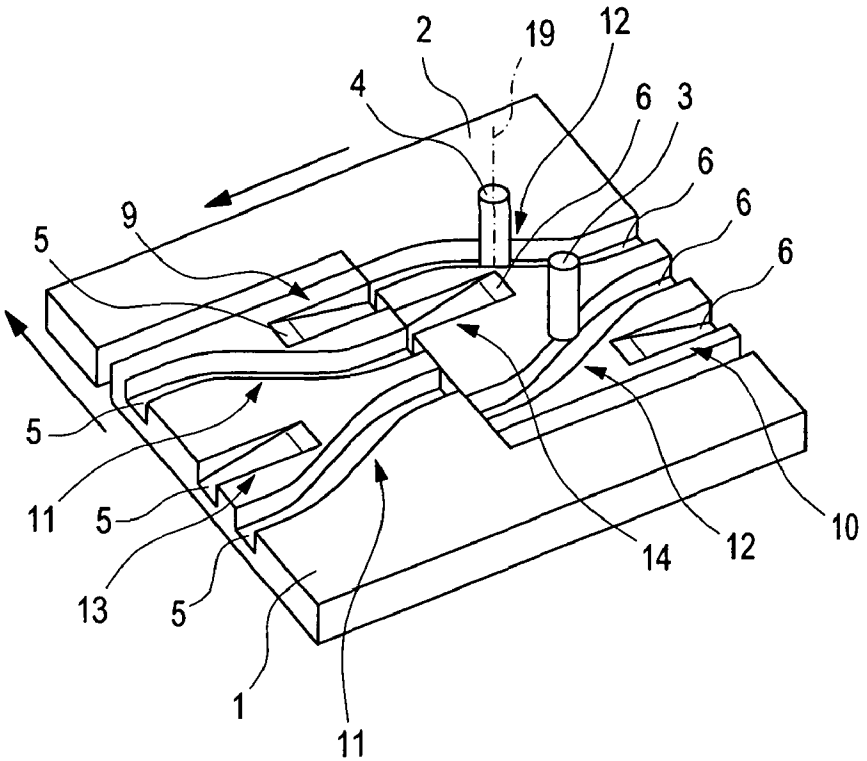
Figure 5A:
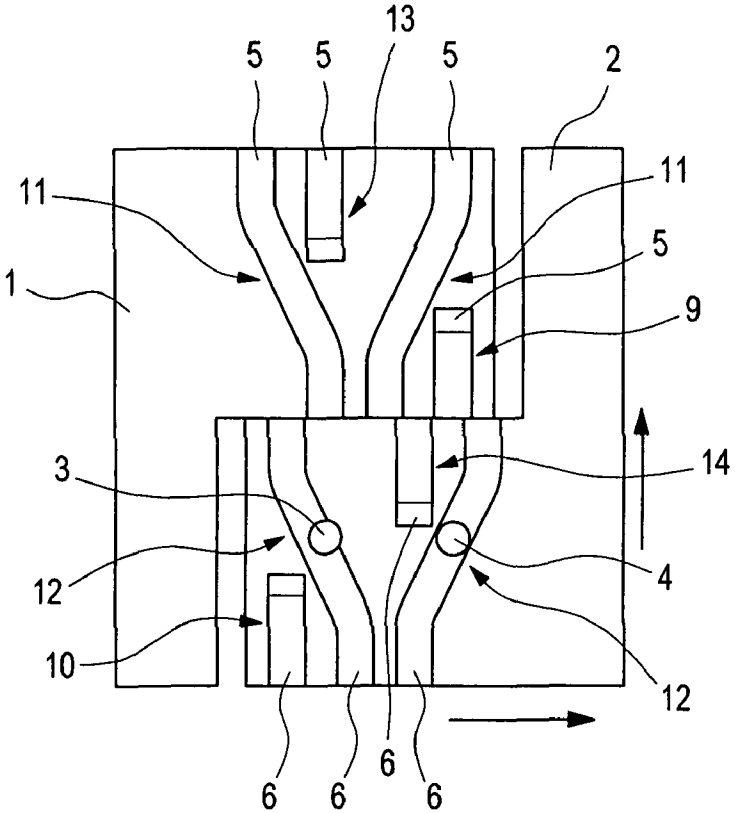
Figure 6B:
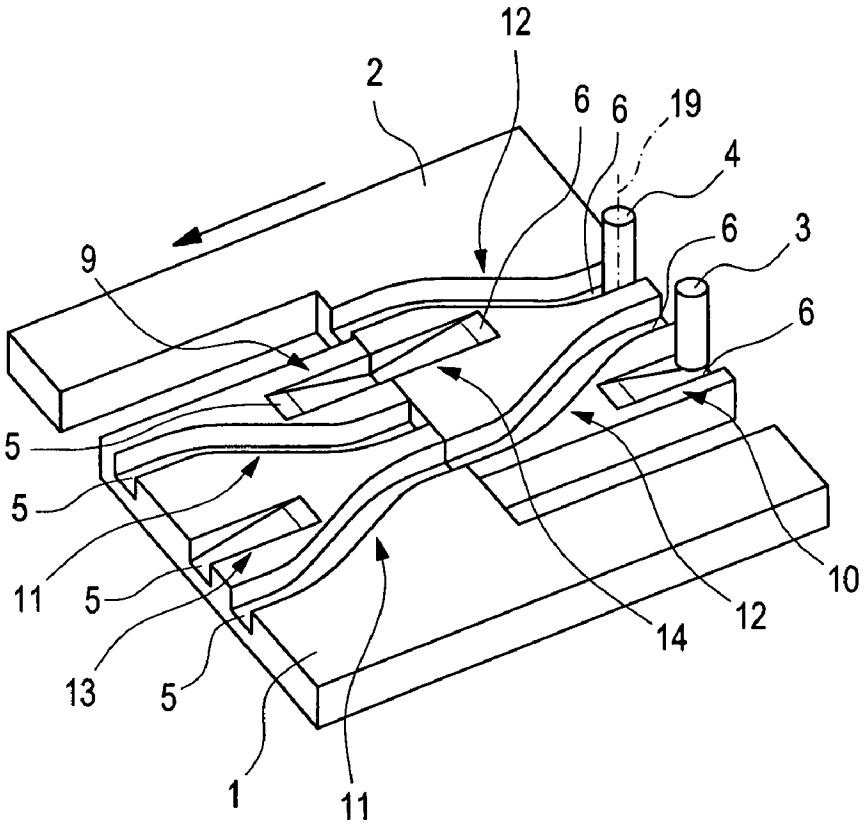
Figure 6A:
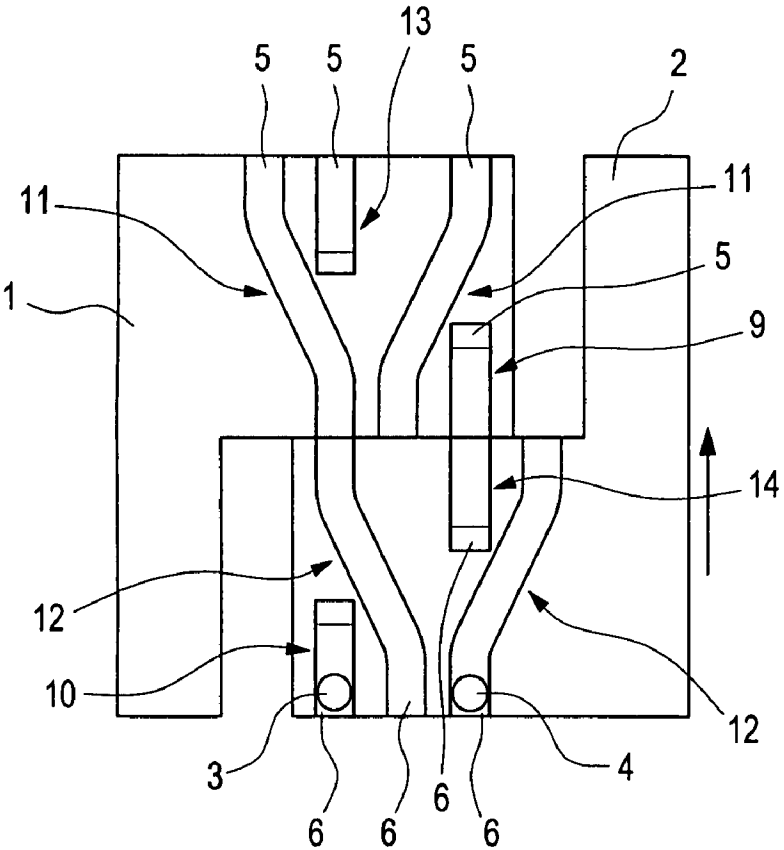
Figure 7B:
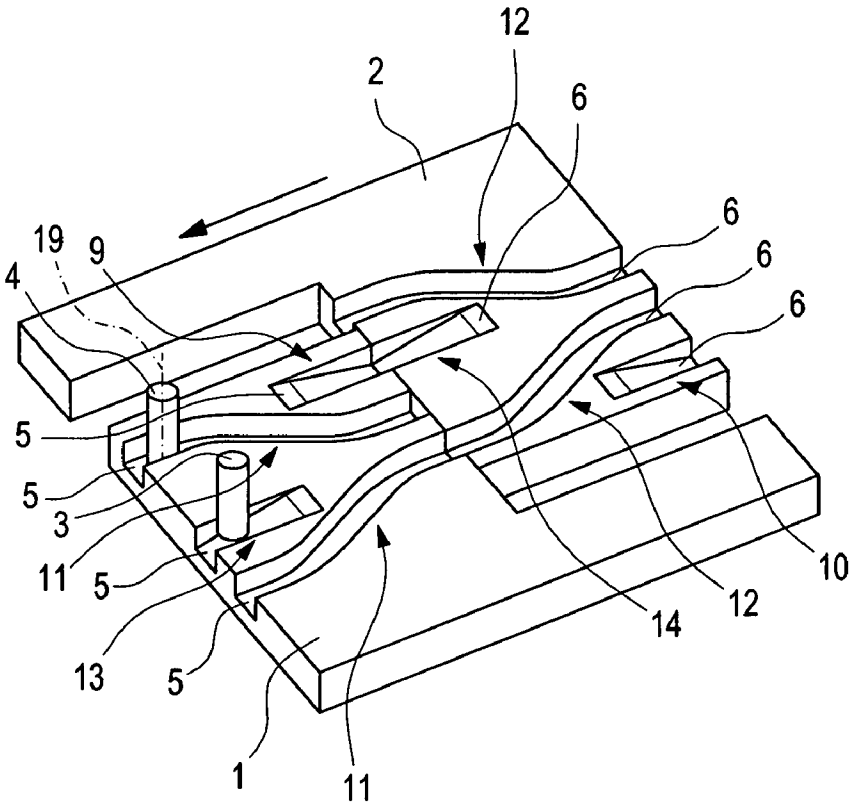
Figure 7A:
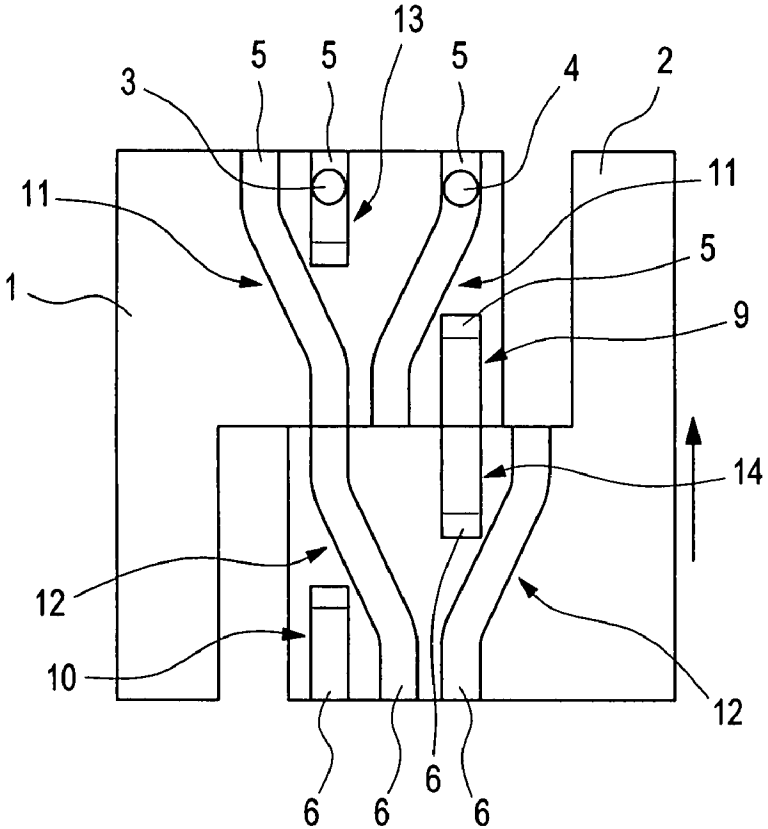
Figure 8B:
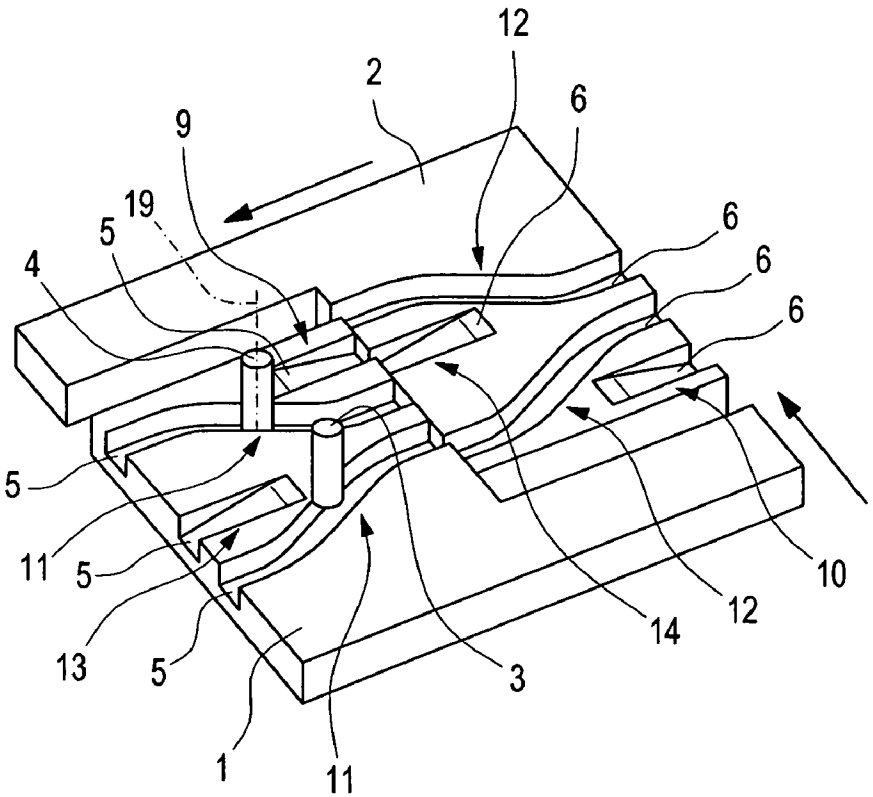
Figure 8A:
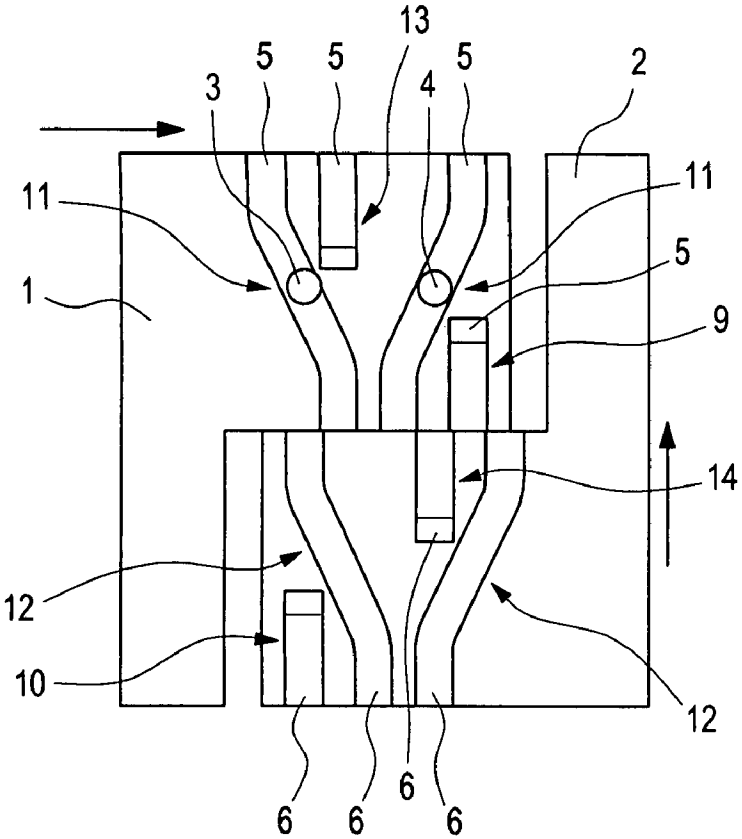
Figure 9B:
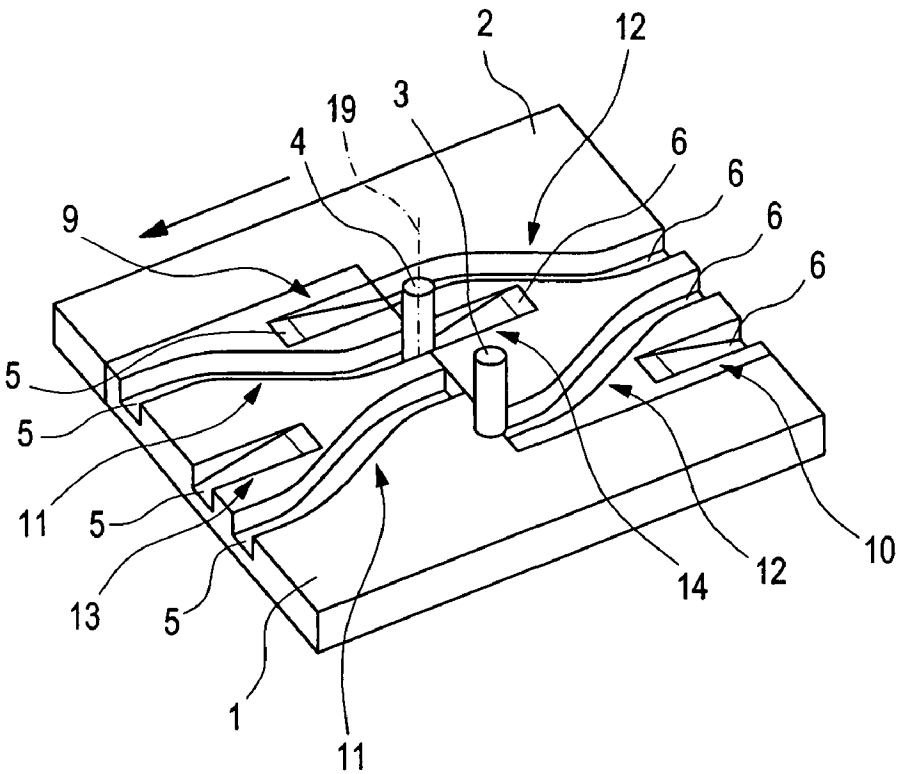
Figure 9A:
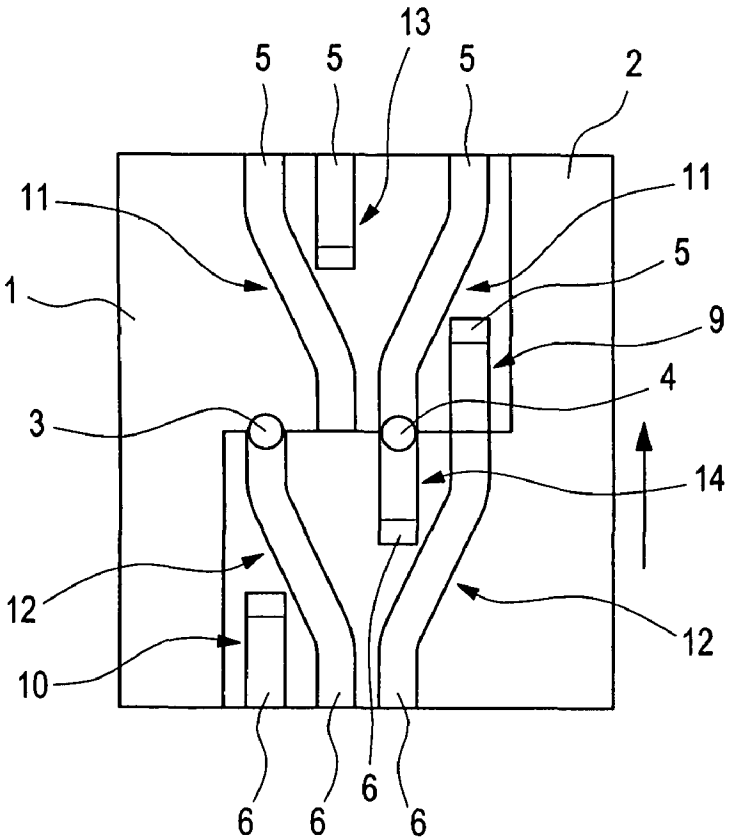
Figure 10B:
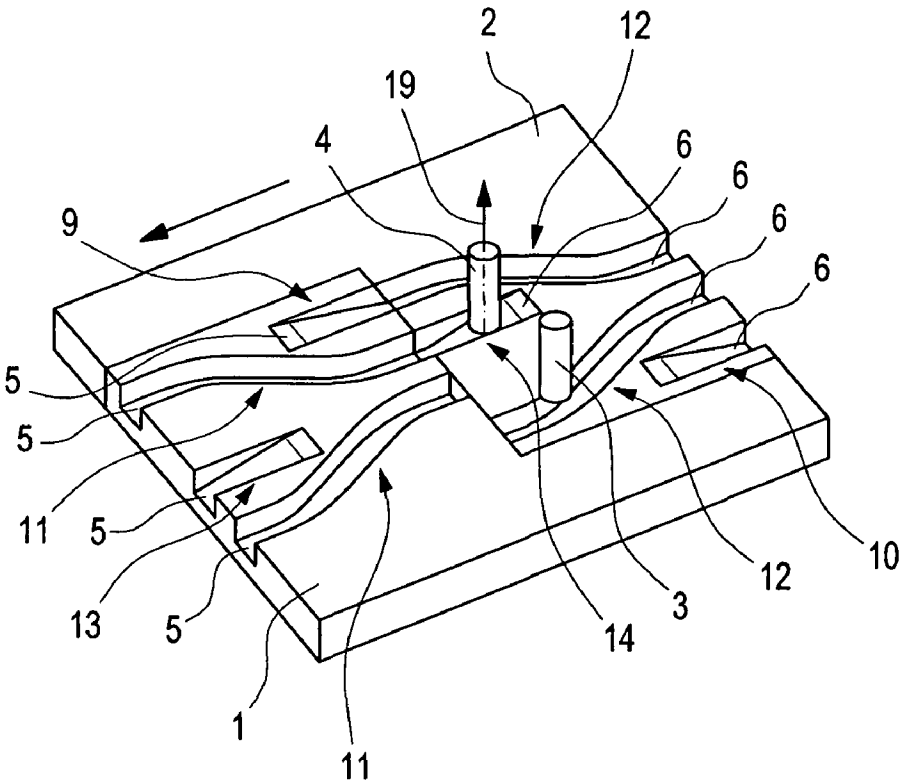
Figure 10A:
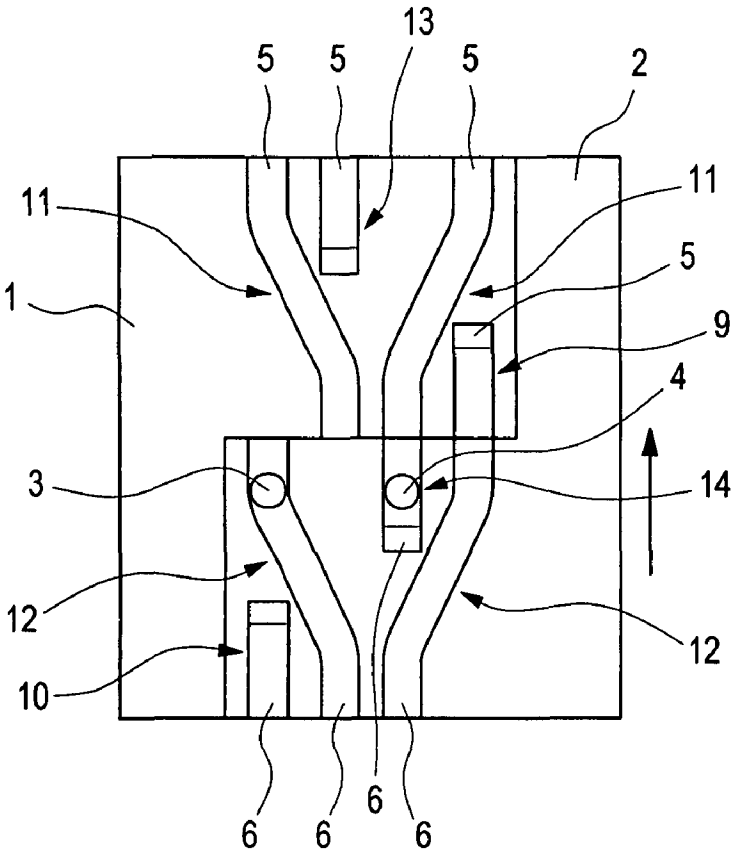
Figure 11B:
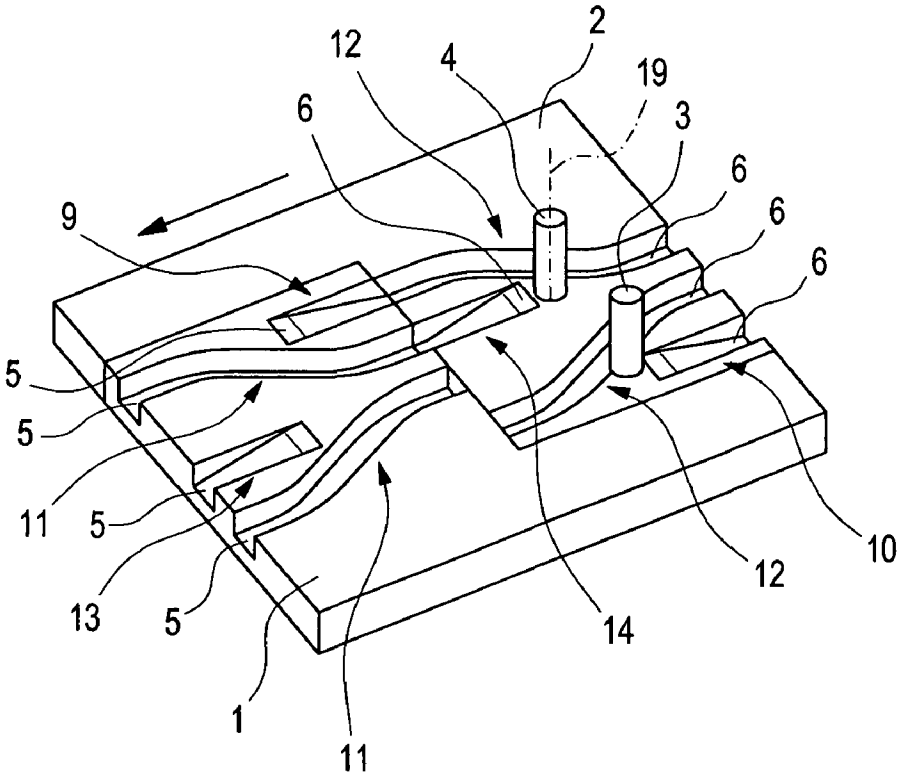
Figure 11A:
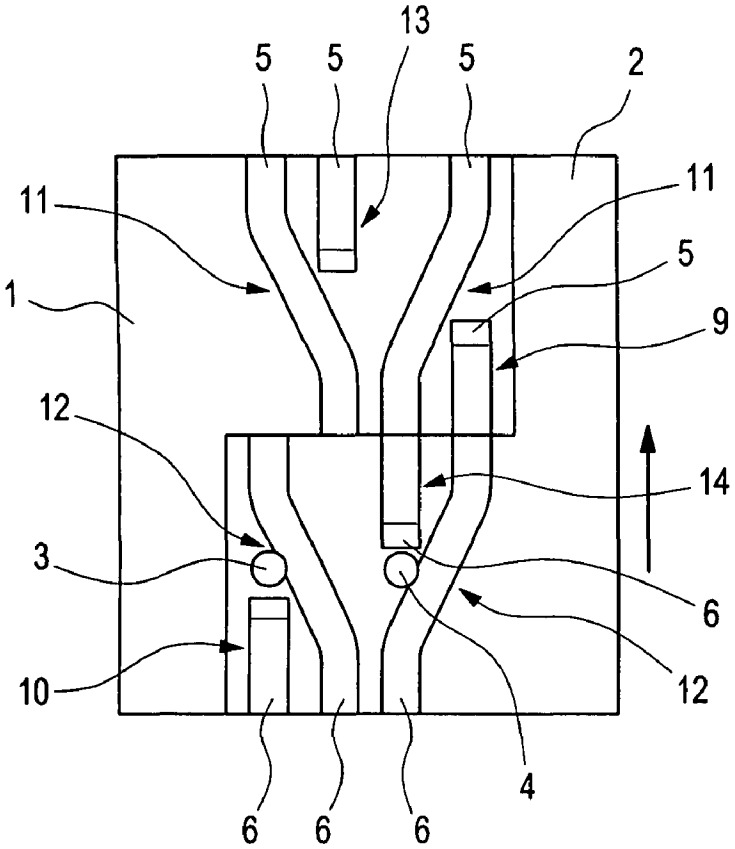
Figure 12B:
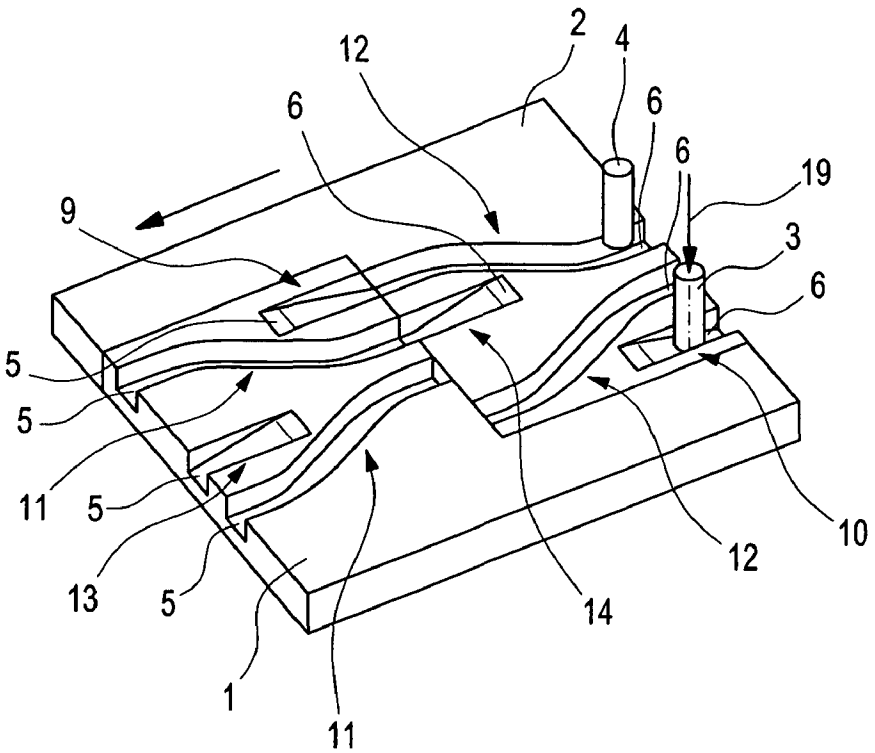
Figure 12A:
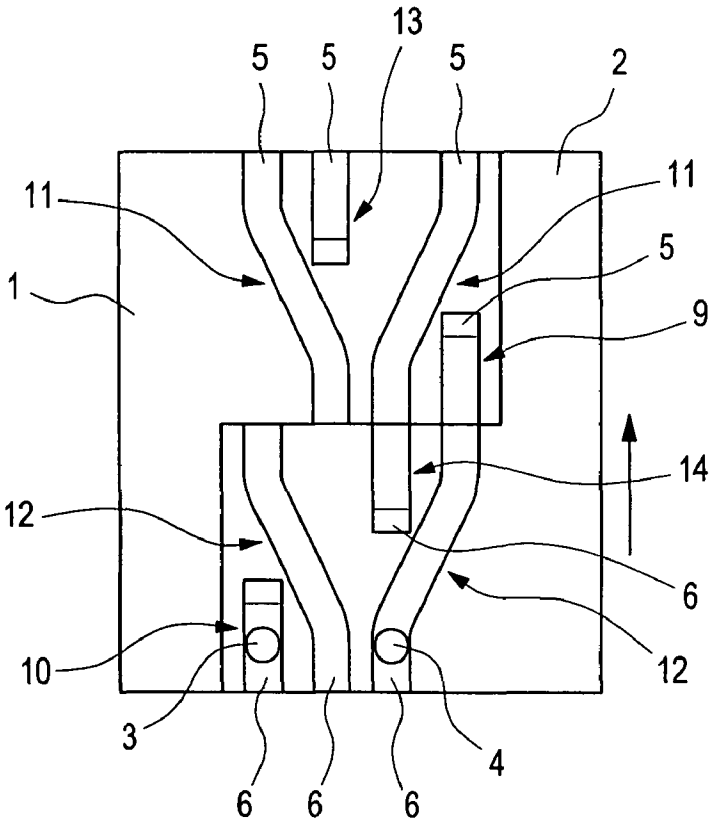
Figure 13B:
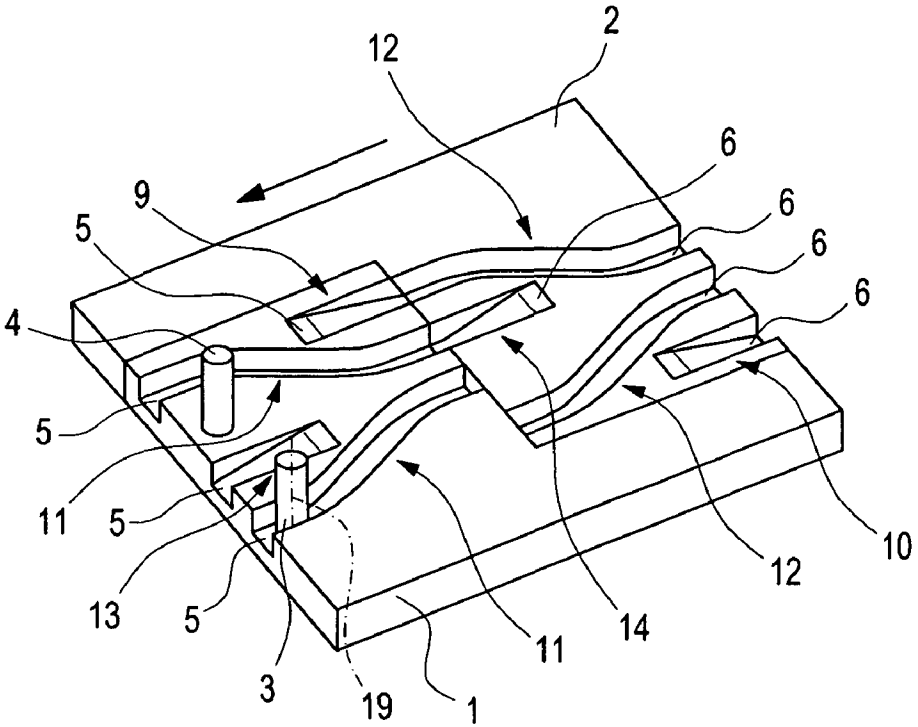
Figure 13A:
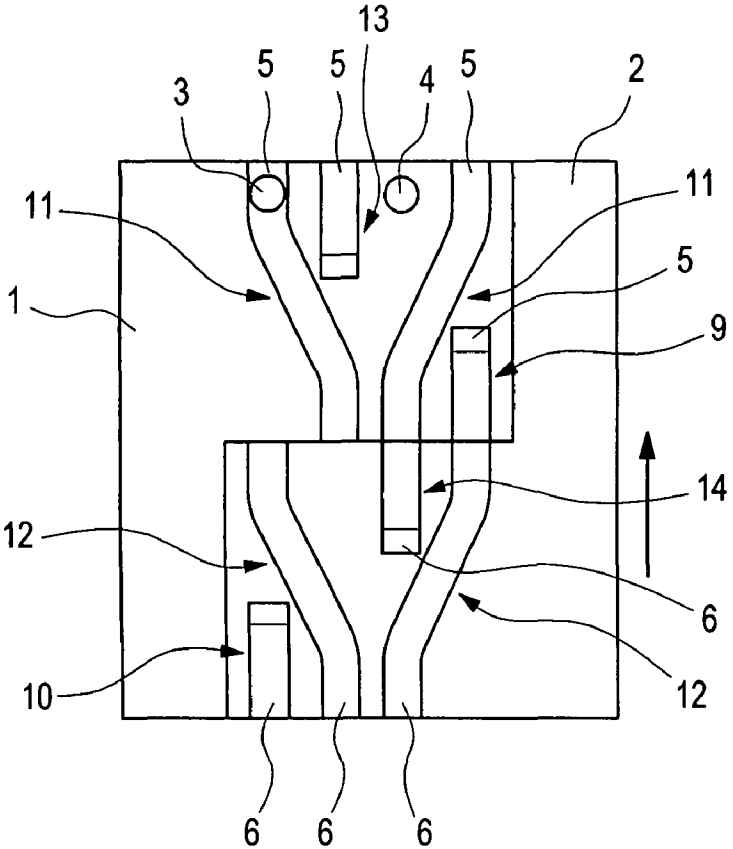
Figure 14B:
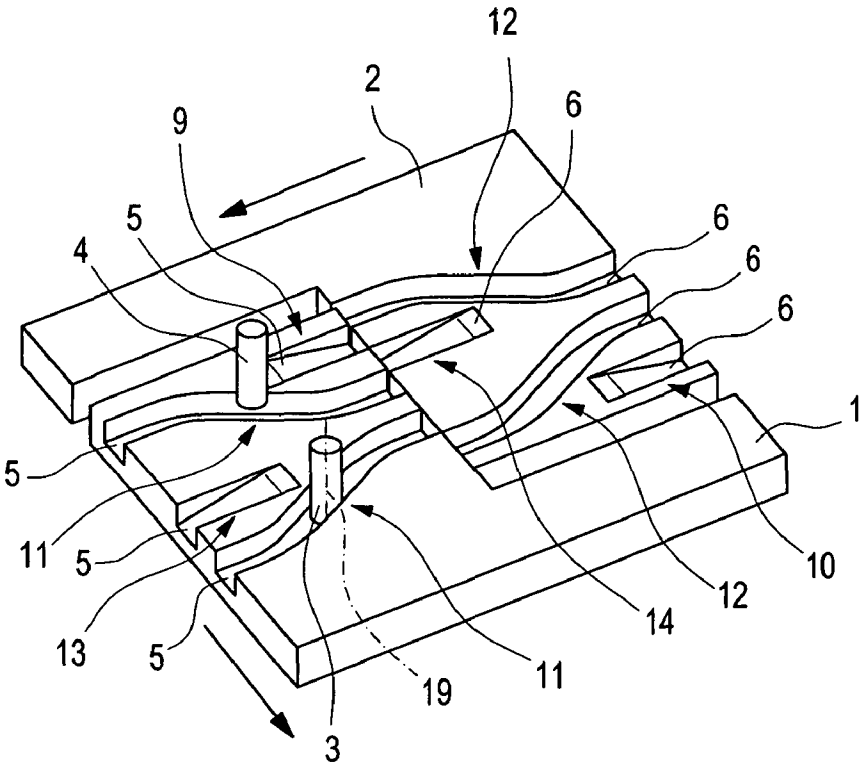
Figure 14A:
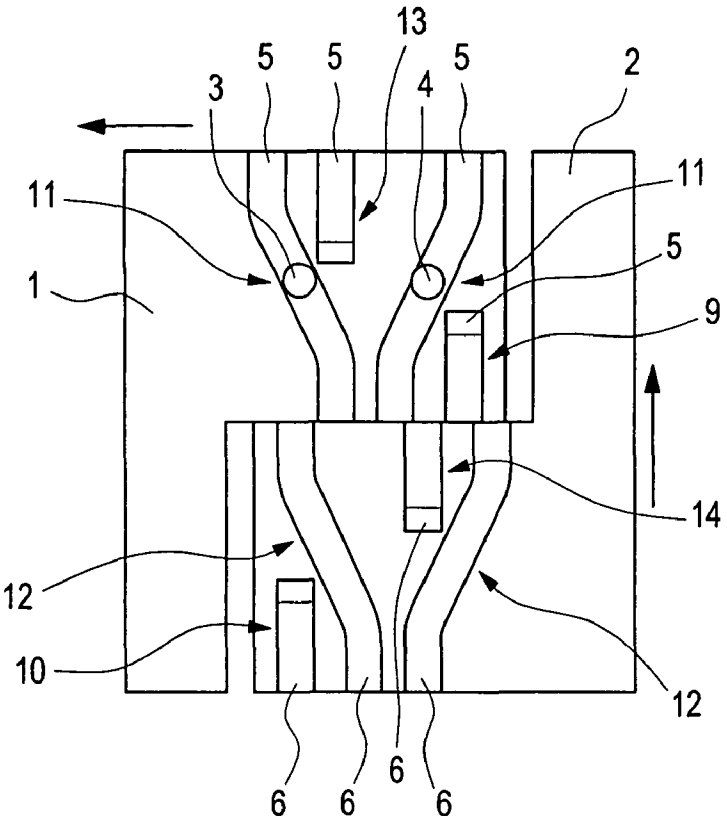
Figure 15B:
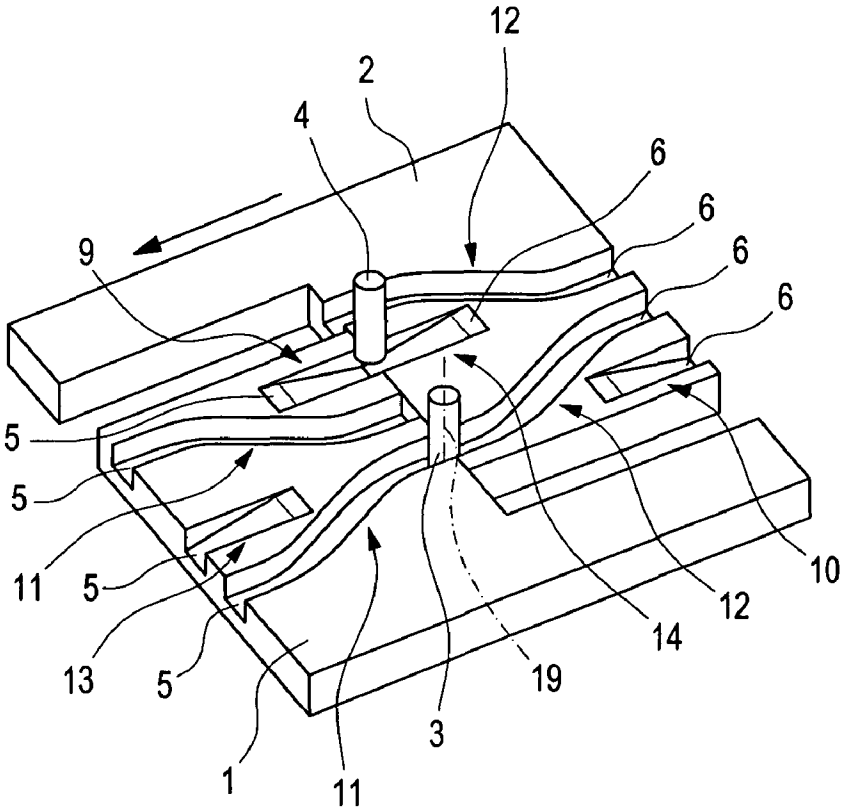
Figure 15A:
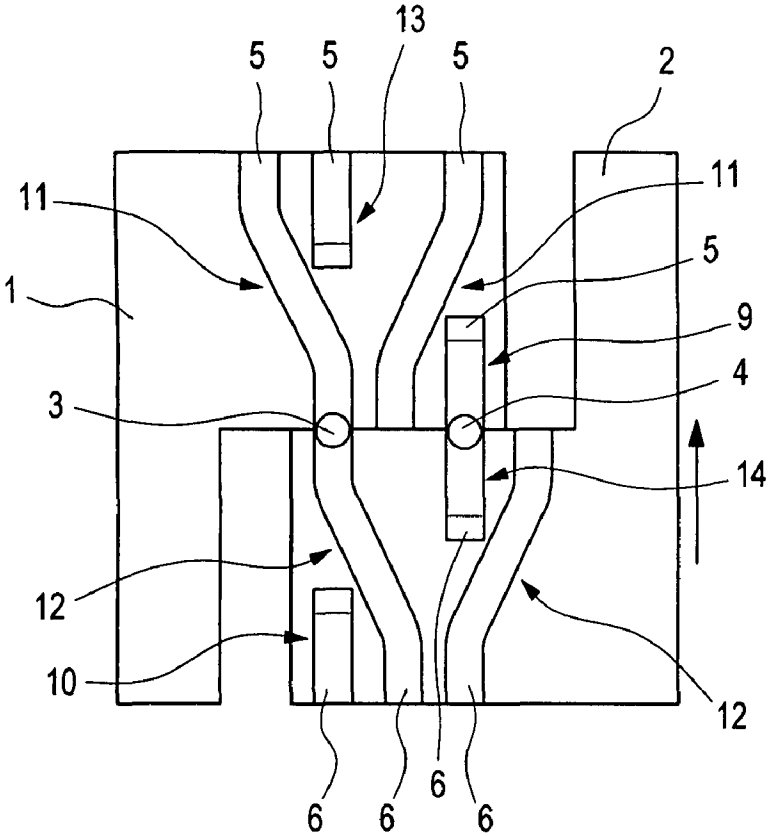
Figure 16B:
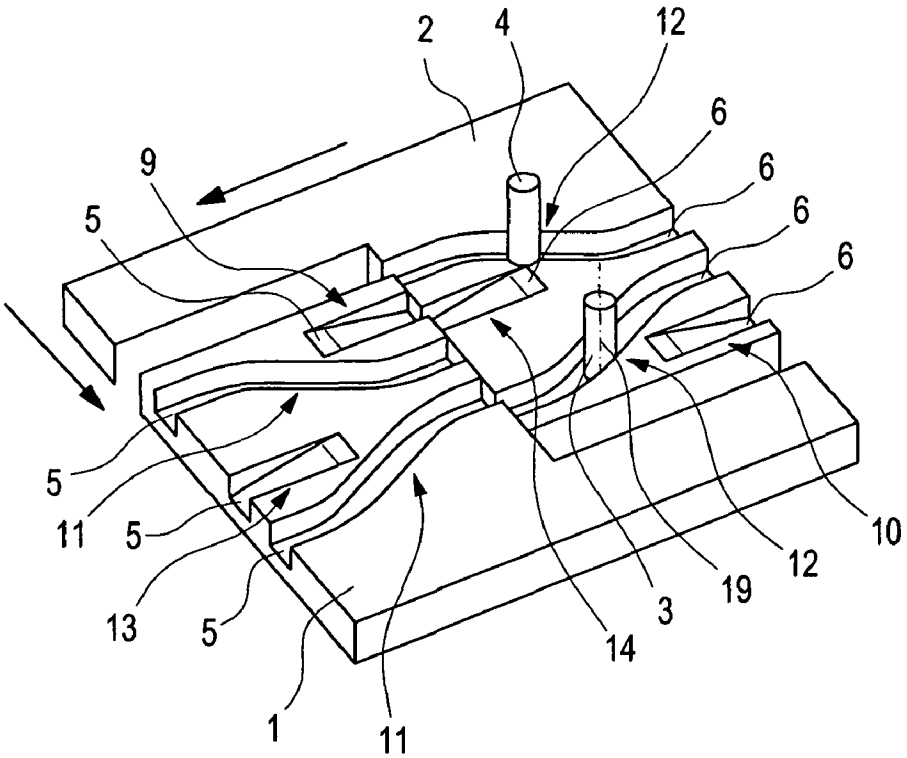
Figure 16A:
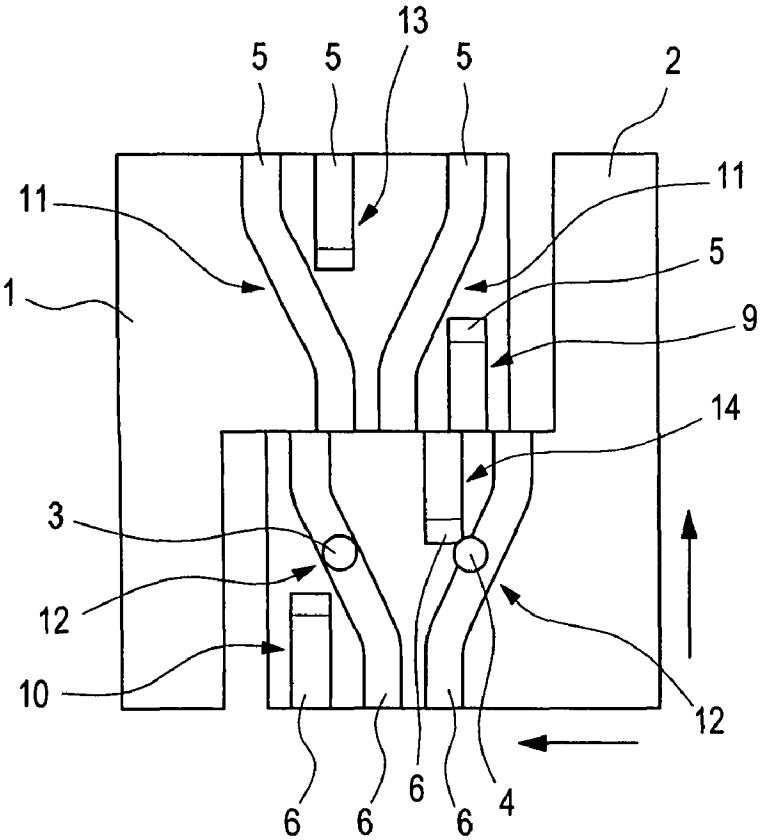
Figure 17B:
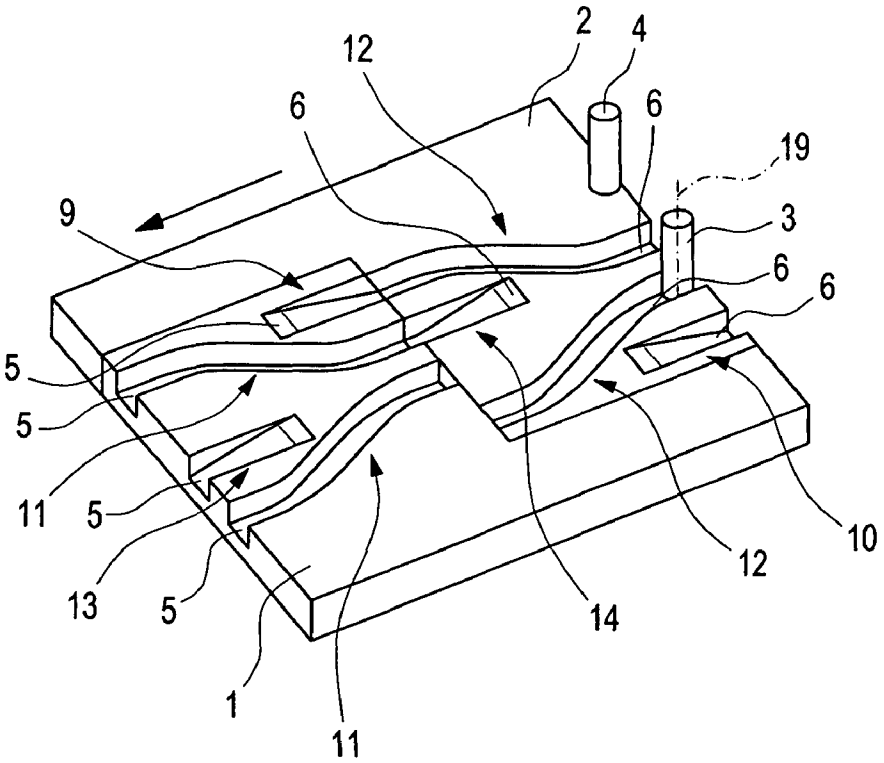
Figure 17A:
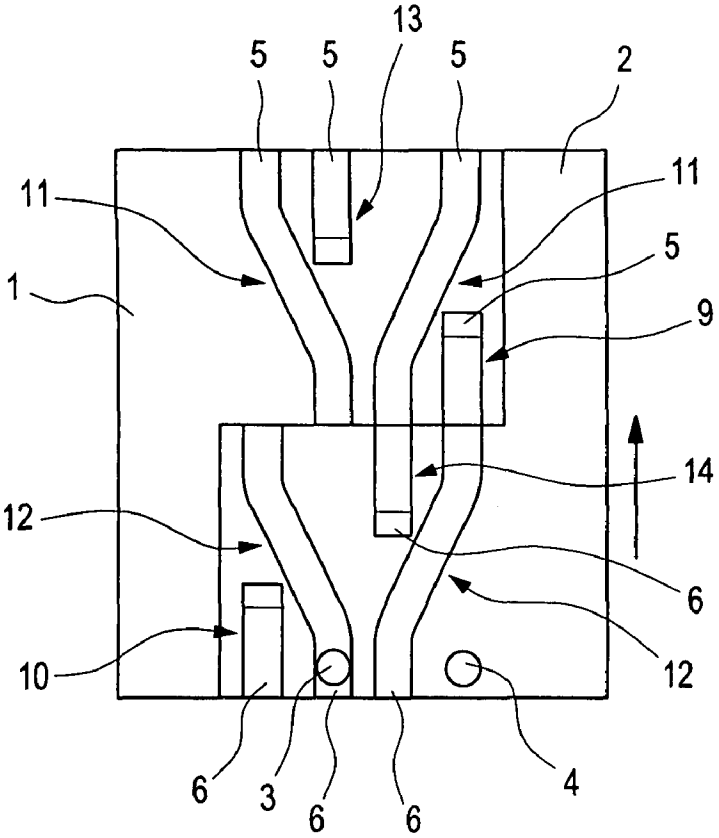
Figure 18B:
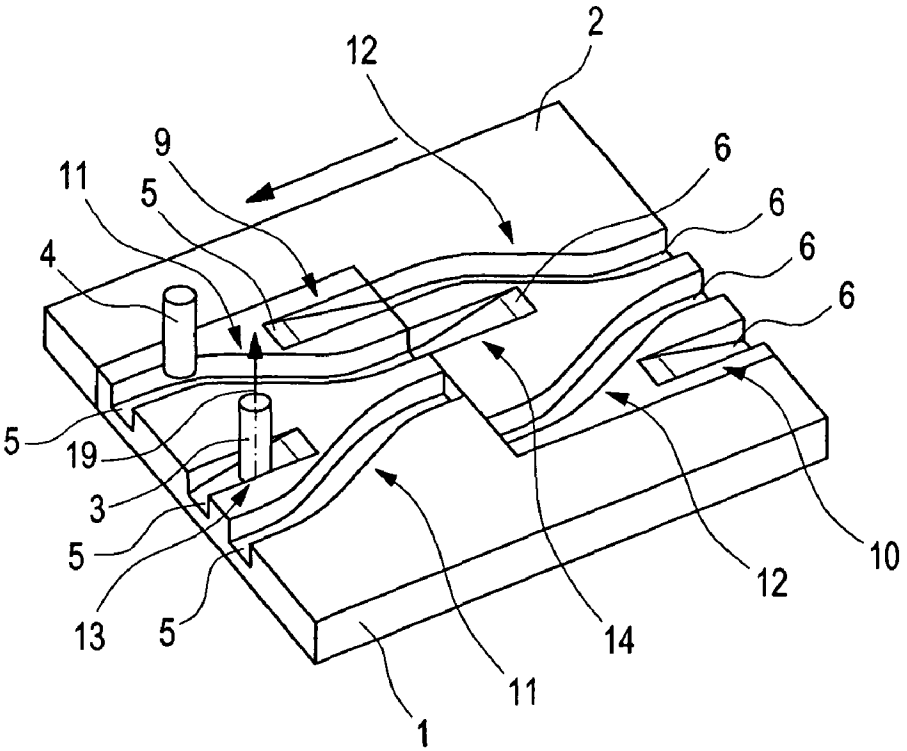
Figure 18A:
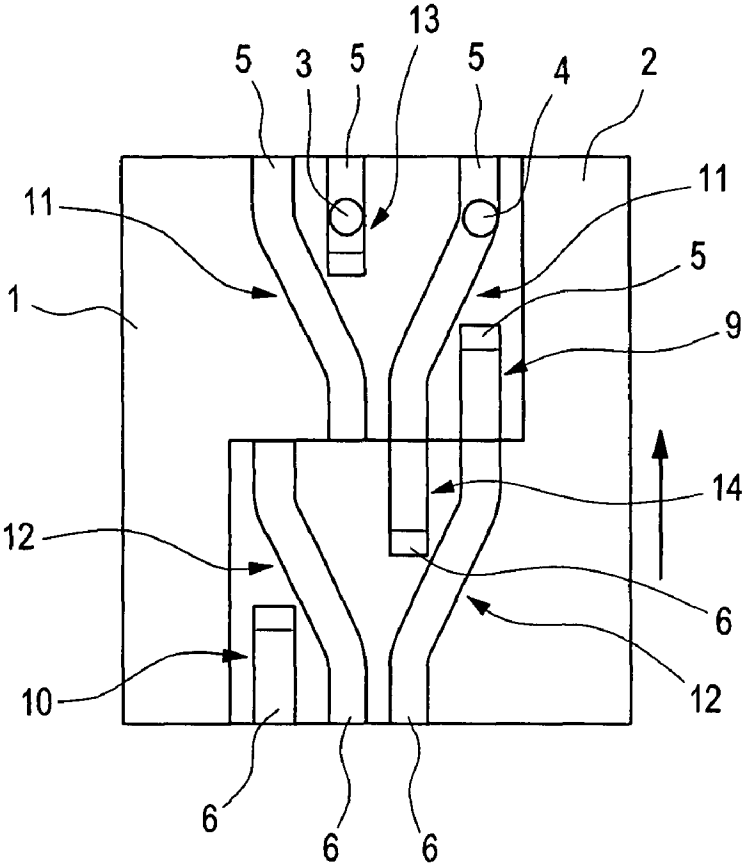
Figure 19B:
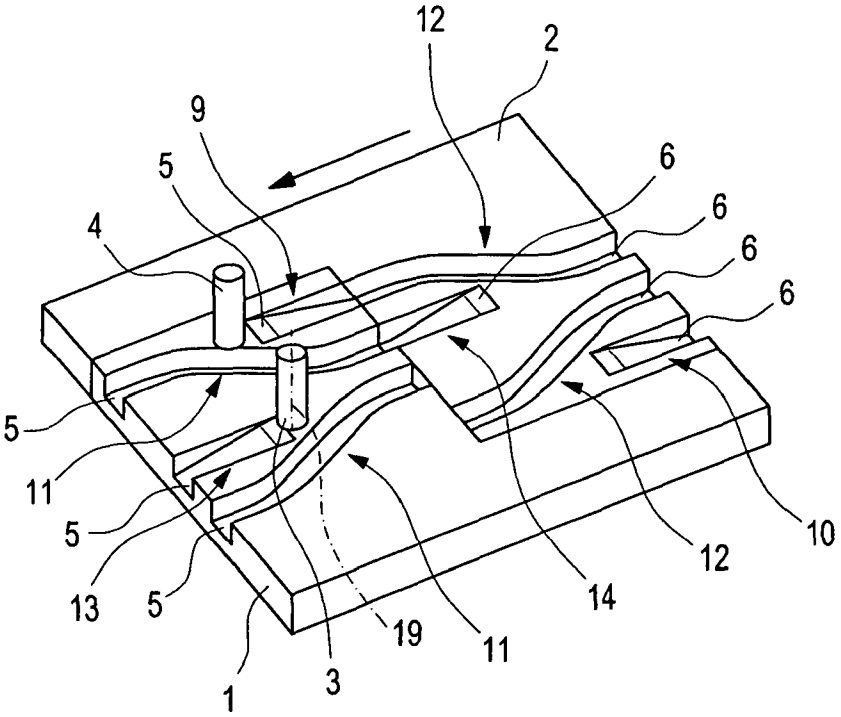
Figure 19A:
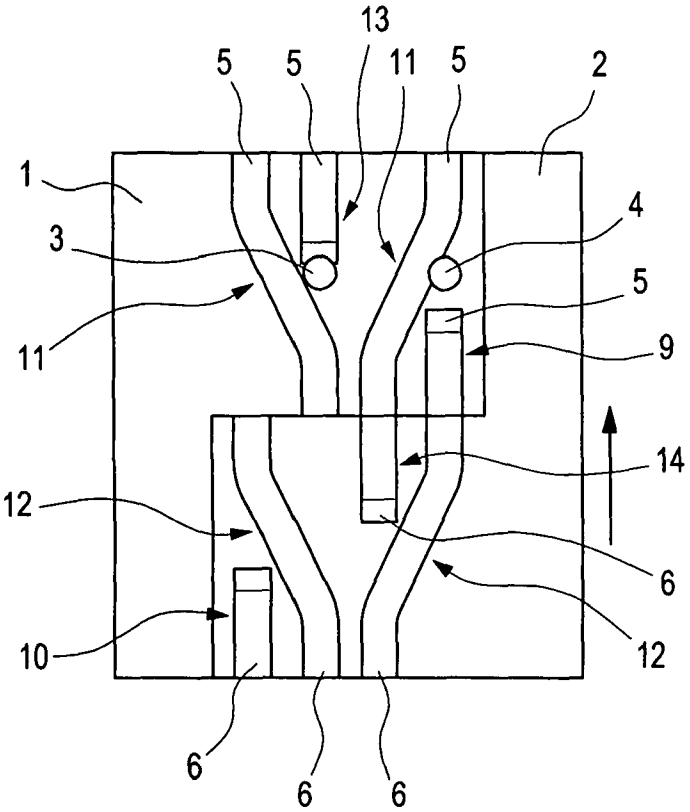

FIG. 3 schematically shows a plan view of the developments of the control tracks 5 and 6, which form a transmission 42, which is formed as a cam transmission. The development of the two control tracks 5, 6 is formed by two L-shaped parts of a development of the switching units 1, 2, which have a rectangular form between two switching processes, with which different switching processes participate. A L-shaped part respectively comprises two halves of the control tracks 5, 6, which belong to different control tracks 5, 6. The control tracks 5, 6 have the sections 9 to 18, which effect different functions of the switching means 3, 4 and/or the switching units 1, 2 in interaction with the switching means 3, 4, wherein the different sections 9 to 18 of the control tracks 5, 6 reach an operative connection with the switching means 3, 4 in dependence on a rotary angle of the camshaft 46 (see FIG. 1).

The sections 9 to 18 are plunging sections 9 and 10, actuation sections 11 and 12, removal sections 13 and 14, change-over sections 15 and 16, and resting sections 17 and 18. The functions are an insertion of the switching means 3, 4 into the insertion section 9, 10 of the control track 5 or 6, a pushing out of the switching means 3, 4 from a removal section 13, 14 of the control track 5 or 6, an actuation of at least one of the switching units 1 or 2 by displacing the switching unit 1, 2 via the switching means 3, 4 in the actuation section 11, 12, a change-over of the switching means 3, 4 from one of the switching units 1, 2 to another switching unit 1, 2, and a resting of the switching movement of one of the switching units 1, 2. The switching means 3, 4 reach an operative connection in dependence on the rotary direction of the camshaft 46 with the sections 9 to 18 in a different sequence.

FIGS. 4*a*, 4*b* to 11*a*, 11 *b* and 12*a*, 12*b* to 19*a*, 19*b* show a switching of valve drive trains by means of individual intermediate states, which are actuated by the cams 7, 8, 48, 50 of the camshaft 46 (see FIG. 1), by axial displacement of the two switching units 1, 2, wherein the switching process to the right is shown in FIGS. 4*a*, 4*b* to 11*a*, 11*b*, and the switching process to the left is shown in FIGS. 12*a*, 12*b* to 19*a*, 19*b*. During the switching process to the left, the switching units 1, 2 move in such a manner that the ends 56, 58 move relative to the switching means 3, 4 in the direction of the cams 48, 50 in a main extension direction 62 (see FIGS. 16*a* and *b*) of the camshaft 46 (see FIG. 1). During a switching process to the right, the switching units 1, 2 move into a main extension direction 60 or opposite thereto (see FIGS. 5*a* and 5*b*). The switching processes to the right and the left respectively consist of two switching processes, in which the individual switching units 1, 2 are moved relative to the switching means,3, 4 in the axial direction.

In the following, the switching process to the right is performed. In a first step according to FIGS. 4*a* and 4*b*, the right switching means 3 is moved into the insertion section 9 of the control track 6 by the actuator 65 (see FIG. 1) based on a signal given in the form of a magnetic field by the actuator 65. In a second step according to FIGS. 5*a* and 5*b*, the right switching means 3 is in the actuation section 12 of the control track 6 and starts to displace the right switching unit 2 in the main extension direction 60 of the camshaft 46 (see FIG. 1), which is an axial direction. In a third step according to FIGS. 6*a* and 6*b*, the displacement of the right switching unit is slowed down and is then completed. After the displacement of the switching unit 2, which is a position change relative to the switching means 3, 4, the switching means 3 actuates the switching unit 1. In a fourth step according to FIGS. 7*a* and 7*b*, the right switching means is just before the actuation section 11 of the control track 6 of the switching unit 1. In a fifth step according to FIGS. 8*a* and 8*b*, the right switching means 3 is in the actuation section 11 of the control track of the left switching unit 1 and starts its displacement in the main extension direction 60. In a sixth step according to FIGS. 9*a* and 9*b*, the displacement of the left switching unit 1 is completed. In a seventh step according to FIGS. 10*a* and 10*b*, the right switching means 3 is in the extension section 14 of the control track 6 of the right switching unit 2 and is pushed back into the starting position in the direction of a vertical axis 19, which proceeds in the radial direction relative to the camshaft 46 (see FIG. 1). In an eighth step according to FIGS. 11*a* and 11*b*, the right switching means 3 is again in the starting position. The two switching processes, in which the switching units 1, 2 are displaced to the right relative to the switching means 3, 4, thus proceed in an automated manner, after the actuator 64 or the actuator 65 (see FIG. 1) has issued the signal, with a rotating camshaft 46, that is, without further signals coming from the outside of the actuating unit 38. The same is valid for the switching processes, in which the switching units 1, 2 are displaced successively to the left. Even though an angular speed with which the camshaft 46 rotates, can change during the first half of a switching process to the left or to the right, in which a switching unit 1, 2 is displaced, the second half of the switching process, in which the other switching unit 1, 2 is displaced axially in the same direction, takes place in an automated manner and independently of another electronic evaluation.

The switching process to the left is described in the following. In a first step according to FIGS. 12*a* and 12*b*, the left switching means 4 is moved into the insertion section 10 of the control track 5 by the actuator 64 (see FIG. 1) based on a signal given by the actuator 64. In a second step according to FIGS. 13*a* and 13*b*, the left switching means 4 is just before the start of the actuating section 11 of the control track 5 in the left switching unit 1. In a third step according to FIGS. 14*a* and 14*b*, the left switching means 4 is in the actuation section 11 of the control track 5 of the left switching unit 1 and starts to displace the left switching unit 1 in the main extension direction 62, which is also the axial direction. In a fourth step according to FIGS. 15*a* and 15*b*, the displacement of the left switching unit 1 to the left is completed. In a fifth step according to FIGS. 16*a* and 16*b*, the displacement of the right switching unit 2 starts into the main extension direction 62 to the left. So as to displace the switching units 1, 2 to the left, the switching means 4 thus has to actuate the switching units 1, 2 independently of each other. In a sixth step according to FIGS. 17*a* and 17*b*, the displacement of the right switching unit 2 is slowed down and is then completed. In a seventh step according to FIGS. 18*a* and 18*b*, the left switching means 4 is in the extension section 13 of the control track 5 of the left switching unit 1 and is pushed back into the starting position in the direction of a vertical axis. In an eighth step according to FIGS. 19*a* and 19*b*, the left switching means 4 is again in the starting position. With a change of the switching means 4 from one switching unit 1, 2 to another switching unit 1, 2, both switching units 1, 2 are actuated simultaneously in a chronological manner. The analog is valid for the switching process to the right. The switching means 3, 4 correspond to the switching units 1, 2 with all described switching processes.

The two switching units 1, 2 can be actuated by the switching means 3, 4 in a defined switching sequence due to the configuration of the control tracks 5, 6. The switching processes to the left and to the right can thus in principle be repeated as often as possible in alternate manner. The switching units 1, 2 are thereby always brought into different switching states by the control tracks 5, 6 to the inserting, actuating, changing and resting states.

The switching units 1, 2 are displaced individually and successively in the same direction to the left or to the right during the switching processes to the left or to the right. The switching units 1, 2 are thus partially decoupled in their movement in the main extension direction of the camshaft 46 (see FIG. 1).

It can be seen by means of the described switching processes that switching processes to the left are performed by means of the left switching means 4, and switching processes to the right are performed by means of the right switching means 3. A switching direction is respectively associated with each switching means 3, 4.

With the described switching of the valve drive trains, the valve lift curves of valves, which are opened and closed due to the rotation of the camshaft 46 in a particular operating mode are changed. Valves can further be switched off by the switching so that they remain closed. A change of the valve lift curves can result in a change of the operating modes of the internal combustion engine.

What is claimed is:

1. An internal combustion engine valve drive train switching arrangement with a switching unit (36), including an actuating unit (38) axially movably disposed on a camshaft and carrying different cams for operating valves of a first and a second cylinder of the internal combustion engine with control tracks (5, 6) formed on the actuating unit (38), the actuating unit (38) comprising two different switching units (1, 2), which are movable relative to and after one another and each includes a set of valve cams for switching the respective cams sequentially one after the other.

2. The internal combustion engine valve drive train switching arrangement according to claim 1, wherein the actuating unit (38) has at least two control means (52, 54) arranged at adjacent ends (56, 58) of at least two of the switching units (1, 2) of the actuating unit (38).

3. The internal combustion engine valve drive train switching arrangement according to claim 1, wherein the control tracks (5, 6) are formed by the control means (52, 54).

4. The internal combustion engine valve drive train switching arrangement according to claim 1, wherein the control track (5, 6) are formed in such a manner that the switching devices (1, 2) can be actuated by a switching means (3, 4) of the actuating unit (38) in a defined switching sequence.

5. The internal combustion engine valve drive train switching arrangement according to claim 1, wherein the actuating unit (38) has switching means (3, 4) for effecting a switching of a valve drive train by an interaction with the control tracks (5, 6).

6. The internal combustion engine valve drive train switching arrangement according to claim 3, wherein the actuating unit (38) has switching means (3, 4) and the switching units (1, 2) have control means (52, 54) for changing, in cooperation with the switching means (3, 4) at least one function of at least one of the switching unit (1, 2) by mutual interaction.

7. The internal combustion engine valve drive train switching arrangement according to claim 1, wherein the actuating unit (38) has switching means (3, 4), which are provided to act upon the control track (5, 6) in a radial direction.

8. The internal combustion engine valve drive train switching arrangement according to claim 1, wherein the actuating unit (38) is provided to carry out a first switching process based on a signal and subsequently a second switching process automatically independently of another signal.

9. The internal combustion engine valve drive train switching arrangement according to claim 1, wherein the actuating unit (38) is designed to effect at least one of a switching of a valve drive train, for changing a valve lift curve, a switch-off of a valve and a change of operating modes of an internal combustion engine.

10. The internal combustion engine valve drive train switching arrangement according to claim 1, wherein the actuating unit (38) comprises at least one switching means (3, 4), and is designed to actuate the switching units (1, 2) in at least one operating mode independently of each other at least independence on positions of the switching units (1, 2) relative to the switching means (3, 4).

11. The internal combustion engine valve drive train switching arrangement according to claim 1, wherein the actuating unit (38) has at least one switching means (3, 4), for actuating the switching units (1, 2) in at least one operating mode at least partially in a chronologically offset manner.

12. The internal combustion engine valve drive train switching arrangement according to claim 1, wherein the actuating unit (38) has at least one switching means (3, 4), which is provided to actuate at least one of the switching units (1, 2) in dependence on a position change of at least one of the switching units (1, 2) relative to the switching means (3, 4).

13. The internal combustion engine valve drive train switching arrangement according to claim 1, wherein the actuating unit (38) has switching means (3, 4), which are associated with different switching directions.

14. The internal combustion engine valve drive train switching arrangement according to claim 1, wherein the switching units (1, 2) are decoupled at least partially in their movement and correspond to at least one switching means (3, 4) of the actuating unit (38).

15. The internal combustion engine valve drive train switching arrangement according to claim 1, wherein the actuating unit (38) is designed to actuate at least two of the switching units (1, 2) simultaneously in at least one operating mode.

16. The internal combustion engine valve drive train switching arrangement according to claim 1, wherein the actuating unit (38) has a camshaft (46), in which the switching units (1, 2) through which valve lift curves of valves associated with the camshaft (46) can be changed at least to a large part, and at least one switching means (3, 4), which is designed to actuate the switching units (1, 2).

17. The internal combustion engine valve drive train switching arrangement according to claim 1, wherein the actuating unit (38) comprises at least one switching means (3, 4) for effecting an axial displacement of the switching unit (1, 2) relative to the switching means (3, 4) by an interaction with at least one switching unit (1, 2) and thereby effect a switching of at least one valve drive train.

18. The internal combustion engine valve drive train switching arrangement according to claim 1, wherein at least one switching unit (1, 2) is in the form of an axially displaceable part of a camshaft (46) with cams (7, 8, 26, 27, 28, 29, 30, 31, 48, 50) having at least a partially different contour.

* * * * *